US010184237B2

(12) United States Patent
Tanimoto et al.

(10) Patent No.: US 10,184,237 B2
(45) Date of Patent: Jan. 22, 2019

(54) DISCHARGE VALVE DEVICE, RESERVOIR TANK DEVICE, AND FLUSH TOILET

(71) Applicant: TOTO LTD., Kitakyushu-shi, Fukuoka (JP)

(72) Inventors: Hideki Tanimoto, Kitakyushu (JP); Kenji Hatama, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 33 days.

(21) Appl. No.: 15/374,441

(22) Filed: Dec. 9, 2016

(65) Prior Publication Data

US 2017/0167125 A1 Jun. 15, 2017

(30) Foreign Application Priority Data

Dec. 14, 2015 (JP) ..... 2015-242823

(51) Int. Cl.
*E03D 1/33* (2006.01)
*E03D 1/14* (2006.01)
*E03D 1/35* (2006.01)

(52) U.S. Cl.
CPC ..... *E03D 1/33* (2013.01); *E03D 1/35* (2013.01); *E03D 1/142* (2013.01)

(58) Field of Classification Search
CPC .. E03D 1/144; E03D 1/35; E03D 1/33; E03D 1/142
See application file for complete search history.

(56) References Cited

U.S. PATENT DOCUMENTS 7,865,979 B2 * 1/2011 Hand ..... E03D 1/34 4/325
8,079,095 B2 12/2011 Jensen
2014/0223656 A1 * 8/2014 Liu ..... E03D 1/144 4/410
2015/0067954 A1 * 3/2015 Chen ..... E03D 1/144 4/324

* cited by examiner

*Primary Examiner* — Janie Loeppke
(74) *Attorney, Agent, or Firm* — Baker & Hostetler LLP

(57) ABSTRACT

In a discharge valve device, a protuberance penetrates a vertical channel with a raised portion engaging a channel. Thus when an attempt is made to rotate a cylindrical body in the circumferential direction with a raised portion engaging a channel, contact between the protuberance right side surface and the vertical channel restricts rotational movement of the cylindrical body in the circumferential direction.

5 Claims, 16 Drawing Sheets

DISCHARGE VALVE DEVICE, RESERVOIR TANK DEVICE, AND FLUSH TOILET

BACKGROUND OF THE INVENTION

Field of the Invention

The present invention relates to a discharge valve device, a reservoir tank device, and a flush toilet.

Description of Related Art

For some time, flush toilets have been known in which a toilet main body is flushed by flush water stored in a reservoir tank device. A discharge valve device is used in this reservoir tank device; as an example of such a discharge valve device, a discharge valve device is used in which a discharge port is opened and closed by raising and lowering a valve body in the vertical direction relative to a discharge port in the flush water tank.

In a known such discharge valve device, a float for applying buoyancy to a valve body is formed as an integral piece with a valve body (e.g., see Patent Document 1 (U.S. Pat. No. 8,079,095)).

However, in a discharge valve device such as that in Patent Document 1, the valve body discharge port release time is essentially fixed at all times, so only a predefined amount of flush water can be supplied to the toilet main body. Because the amount of flush water varies with toilet type, a discharge valve device cannot be applied to other types of toilet.

A discharge valve device capable of adapting to differing toilet types by adjusting the amount of flush water is therefore desired. However, the amount of flush water differs according to toilet type. Therefore when applying such discharge valve devices to a toilet, it is preferable for the flush water amount not to be easily changed by a user or by external interference after the discharge valve device is installed, so the flush water amount can be adjusted to a level appropriate to the type of toilet used.

BRIEF SUMMARY OF THE INVENTION

The present invention was undertaken to resolve the above-described problems, and has the object of providing a discharge valve device capable of adapting to differing types of toilet by adjusting flush water amounts, wherein the flush water amount cannot be easily changed by a user or external interference after installation and adjustment to a flush water amount appropriate to the toilet applied.

The present invention is a discharge valve device attached to a reservoir tank for storing flush water, the discharge valve device being configured to open and close a discharge port disposed on a bottom surface of the reservoir tank, the discharge valve device comprising: a valve body configured to move up and down so as to open and close the discharge port; a float mounted to the valve body, the float being configured to drop in tandem with a lowering of a water level inside the reservoir tank; and a drop start variable timing mechanism attached to the float, the drop start variable timing mechanism being configured to vary a timing at which the valve body starts to drop; wherein the drop start variable timing mechanism includes: a reservoir having a sidewall over an entire circumference on an outer circumference side of the reservoir so that flush water can be stored up to a top end of the sidewall; an adjustment portion configured to set a height from a bottom surface of the reservoir to the top end of the sidewall, the adjustment portion being configured to adjust a flush water amount stored in the reservoir; and wherein the adjustment portion includes: a support device configured to position a height position of the top end of the sidewall relative to the bottom surface of the reservoir; and a lock device configured to prevent the support device from being released to position the height position of the top end of the sidewall relative to the bottom surface of the reservoir.

According to the present invention thus constituted, using a lock device disposed on the adjusting portion, preventing the support device from being released to position the height position up to the top end of the sidewall relative to the bottom surface of the reservoir enables the height of the drop start variable timing mechanism sidewall height to be prevented from being easily changed once the sidewall height is set. Hence the flush water amount cannot be easily changed by a user or by external interference after an installation in which the flush water amount is adjusted to match the type of toilet applied.

In the present invention, the drop start variable timing mechanism includes: an outer cylinder configured to open upward; a cylindrical body configured to be inserted from above into an inside of the outer cylinder, the cylindrical body being affixed to the inside of the outer cylinder; wherein the support device includes: multiple channels at differing height positions, the multiple channels being disposed on a side surface of the outer cylinder; and a raised portion configured to project from a side surface of the cylindrical body outwardly, the raised portion being configured to engage one channel of the multiple channels when the cylindrical body is rotated in a circumferential direction of the cylindrical body; and wherein the lock device prevents the cylindrical body from rotating in the circumferential direction when the raised portion engages in the channel.

According to the present invention thus constituted, rotational movement in the circumferential direction when the raised portion engages in the channel is restricted by the lock device disposed on the adjusting portion, therefore engagement of the projecting portion and the channel is not easily released once the projecting portion and the channel are made to engage and the height of the sidewall is set. Hence the flush water amount cannot be easily changed by a user or by external interference after installation and adjustment of the flush water amount to match the type of toilet applied.

In the present invention, the lock device includes: a vertical channel disposed on the side surface of the outer cylinder; and a protuberance protruding from the side surface of the cylindrical body, the protuberance being configured to be inserted into the vertical channel when the raised portion engages in the channel; and wherein a bottom surface of the protuberance is configured to be sloped upward toward an outside of the protuberance.

According to the present invention thus constituted, the bottom surface of the protuberance is sloped upward toward the outside circumference. When the cylindrical sidewall is inserted from above into the inside of the outer cylinder, the bottom surface of the protuberance is inserted as it slides on the top end of the outer cylinder, thereby facilitating insertion of the sidewall into the outer cylinder.

In the present invention, the discharge valve device may also be disposed on the reservoir tank device.

According to the invention thus constituted, the flush water amount can be prevented from being easily changed by a user or by external interference after installation in which the flush water amount is adjusted to match the type of toilet applied.

In the present invention, a reservoir tank device comprising a discharge valve device may also be disposed on the flush toilet.

According to the invention thus constituted, the flush water amount can be prevented from being easily changed by a user or by external interference after installation in which the flush water amount is adjusted to match the type of toilet applied.

According to the present invention, in a discharge valve device capable of adapting to differing types of toilet by adjusting the flush water amount, the flush water amount can be prevented from being easily changed by a user or by external interference after installation in which the flush water amount is adjusted to match the type of toilet applied.

DETAILED DESCRIPTION OF THE INVENTION

Figure 1:
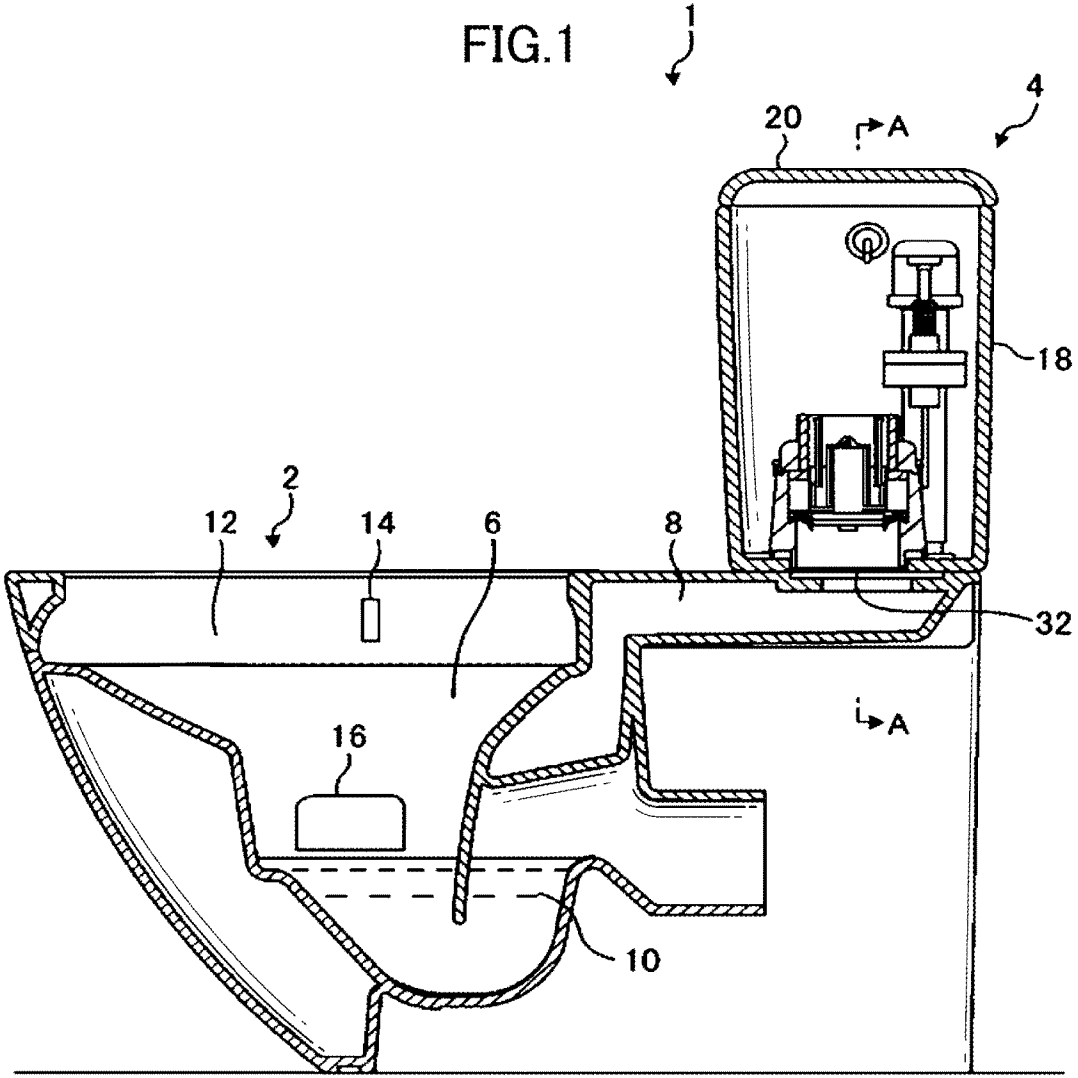
FIG. 1 is a side elevation cross section showing a flush toilet in an embodiment of the invention.

First, referring to FIG. 1, we explain a flush toilet in a first embodiment of the invention. FIG. 1 is a side elevation cross section showing a flush toilet in a first embodiment of the invention.

As shown in FIG. 1, the flush toilet device 1 in the present embodiment comprises: a toilet main body 2 disposed on the floor surface of a toilet room; and a reservoir tank device 4, disposed on the top portion at the rear of this toilet main body 2, for holding flush water supplied to the toilet main body 2.

The toilet main body 2 comprises: a bowl 6 for receiving waste; a water conduit 8 for guiding flush water supplied from the reservoir tank device 4 to the bowl 6; and a discharge trap pipe 10, the intake of which is connected to the bottom portion of the bowl 6, for discharging waste in the bowl 6 to an external discharge pipe (not shown).

The bowl 6 comprises: a rim 12 which overhangs on the inside at the top edge of the bowl; a first spout port 14, disposed on the toilet left side of this rim 12, for spouting flush water supplied from the water conduit 8; and a second spout port 16, disposed at a position above the reservoir water surface on the toilet left side, for horizontally spouting flush water supplied from the water conduit 8.

The discharge trap pipe 10 comprises an ascending path extending upward from the intake thereof; and a descending path, extending downward from the end of this ascending path and connected to an external discharge pipe (not shown). Flush water for forming a water sealed state is accumulated from the bowl 6 to the ascending path of the discharge trap pipe 10. Note that stored flush water is referred to as the "reserved water," and the surface of the reserved water is the reserved water surface.

The flush toilet device 1 is a "wash-down" type of toilet, in which waste is pushed out by the flow effect created by the drop in flush water within the bowl 6. In the flush toilet device 1, flush water spouted from the first spout port 14 forward flushes the bowl 6 as it circulates; furthermore, flush water spouted from the second spout port 16 circulates in a vertical direction, stirring the waste so that it is pushed out to the discharge trap pipe 10. The present invention is not limited to such wash-down type toilets, and may also be applied to other toilet types, such as siphon toilets and the like.

Figure 2:
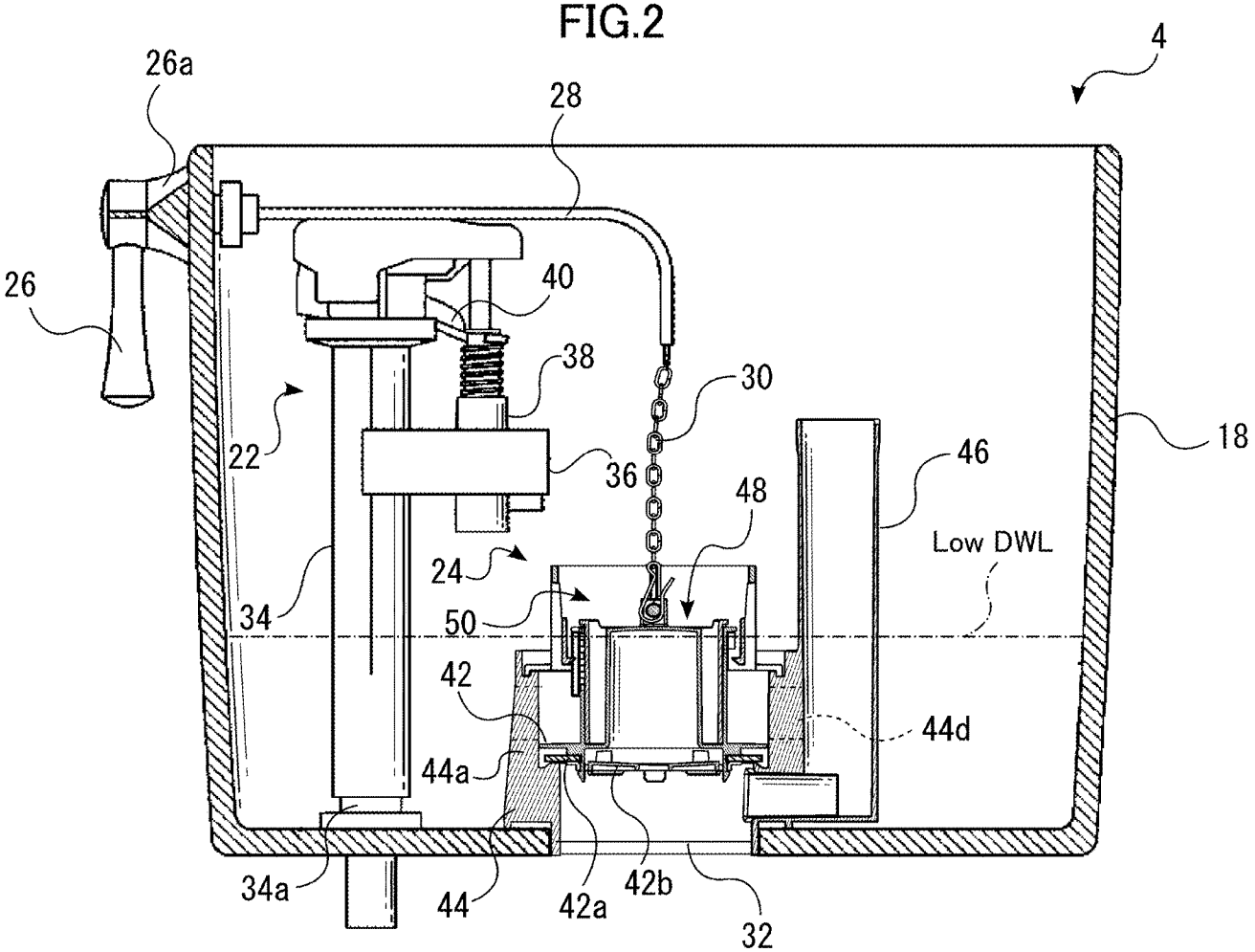
FIG. 2 is a cross section through A-A in FIG. 1.

Next, referring to FIG. 2, we explain a reservoir tank device in the present embodiment. FIG. 2 is a cross section through A-A in FIG. 1.

As shown in FIG. 2, the reservoir tank device 4 comprises: a reservoir tank 18 for holding flush water; a cover 20 for this reservoir tank 18; a water supply device 22 disposed inside the reservoir tank 18; and a discharge valve device 24.

The reservoir tank 18 is made, for example, of ceramic, and is an approximately rectangular vessel, open at the top. The upper opening is normally closed by a ceramic cover 20, for example (see FIG. 1). Note that no cover 20 is depicted in FIG. 2.

A lever handle 26 is disposed on the outside surface of the reservoir tank 18. The lever handle 26 turns around the axis of its base portion 26*a*. In addition, a spindle 28 extending approximately horizontally into the reservoir tank 18 and bent downward at the end into an approximately L shape, is connected on the same shaft as the lever handle 26 rotational shaft. Through rotary operation of the lever handle 26, the spindle 28 rotates toward the front and rear directions as seen in FIG. 2.

The tip of the spindle 28 is positioned approximately immediately above the discharge valve device 24. One end of a bead chain 30 serving as a linking member is connected to the tip end of the spindle 28. The other end of this bead chain 30 is connected to a float 48, described below, in the discharge valve device 24.

A discharge port 32 is placed on the bottom surface of the reservoir tank 18; this discharge port 32 communicates with the water conduit 8 (see FIG. 1) and supplies flush water to the water conduit 8. The discharge port 32 is opened and closed by the discharge valve device 24.

A water supply device 22 is disposed inside the reservoir tank 18. The water supply device 22 comprises: a supply pipe 34, a small tank 36, and a supply float 38. The supply pipe 34 is connected to a supply source (not shown) outside the reservoir tank 18, and extends upward from the bottom surface of the reservoir tank 18. At the bottom portion of the supply pipe 34, a supply port 34*a* for supplying flush water into the reservoir tank 18 is disposed at the bottom portion of the supply pipe 34.

In addition, a diaphragm-type supply valve (not shown) is disposed at the top portion of the supply pipe 34; switching between supplying and stopping the reservoir tank 18 with flush water supplied from the supply pipe 34 is accomplished by this supply valve.

The small tank 36 is an approximately rectangular vessel, and is disposed to be freely attached and detached from the side of the supply pipe 34. A reversible valve (not shown) for opening and closing the opening (not shown) disposed on the bottom surface is placed on the small tank 36. A supply float 38 is disposed inside the small tank 36, and moves up and down in response to the water level inside the small tank 36.

The supply float 38 is connected through a float body 40 to a water supply valve (not shown), and opens and closes the water supply valve by its up and down movement. Specifically, because flush water stored in the small tank 36 is discharged from an opening (not shown) formed on the bottom surface thereof, the supply float 38 drops as the water level inside the small tank 36 drops. The water supply valve is released when the supply float 38 drops, and flush water is supplied into the reservoir tank 18 from the supply port 34*a*.

Figure 3:
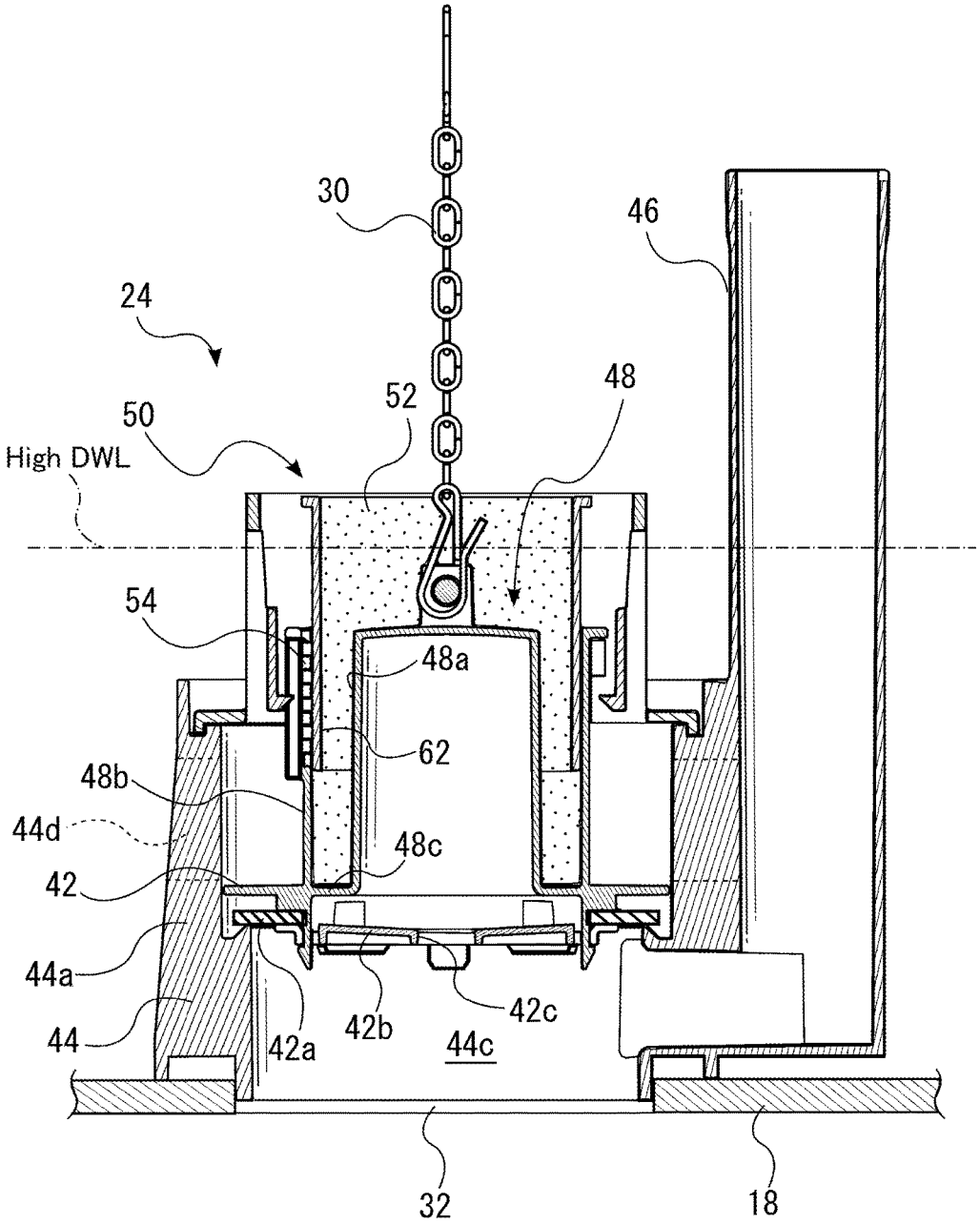
FIG. 3 is a cross section wherein the dead water level in a discharge valve device according to the embodiment of the invention is set to a high position (high DWL).
Figure 4:
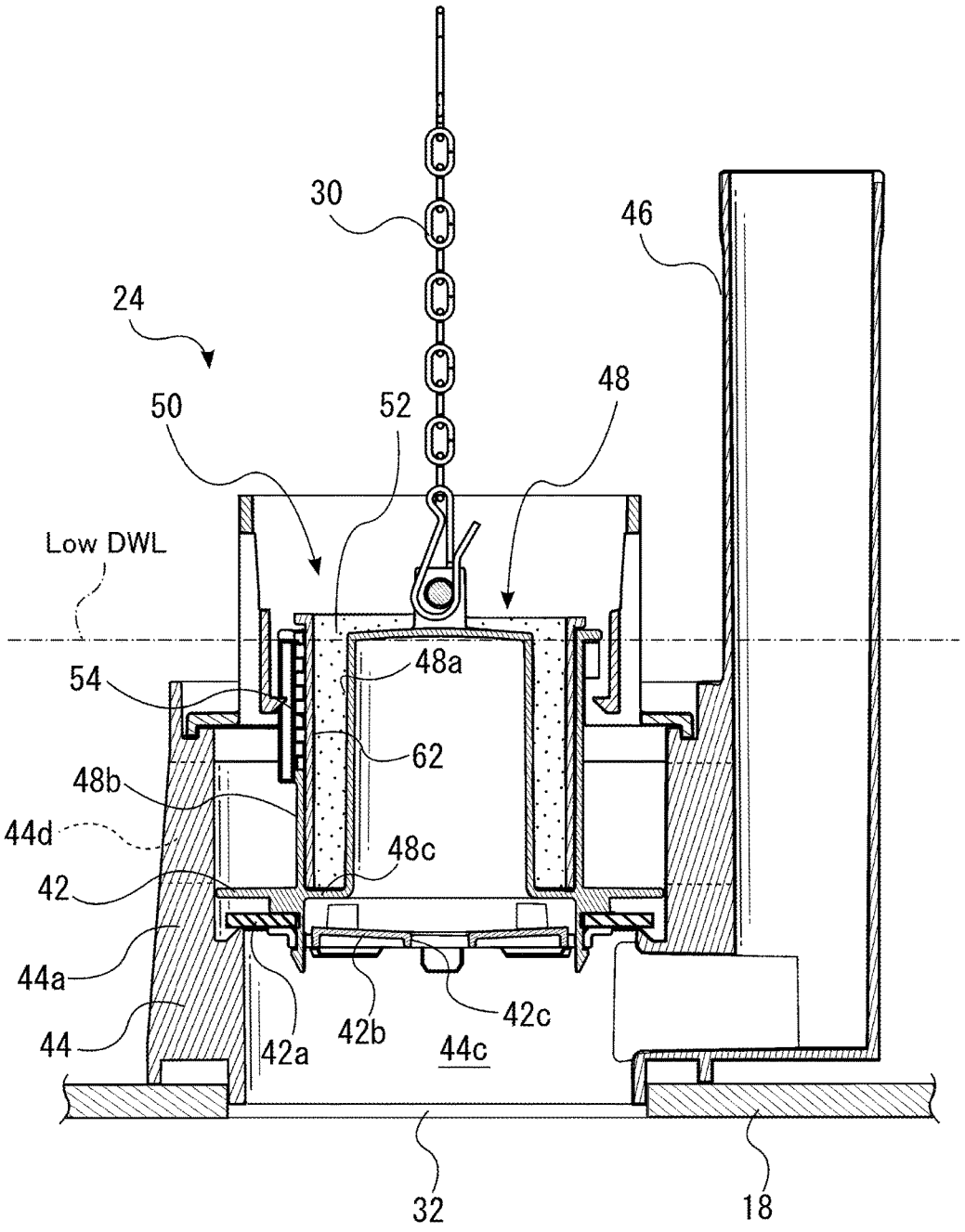
FIG. 4 is a cross section wherein the dead water level in the embodiment of the invention is set to a low position (low DWL).
Figure 5:
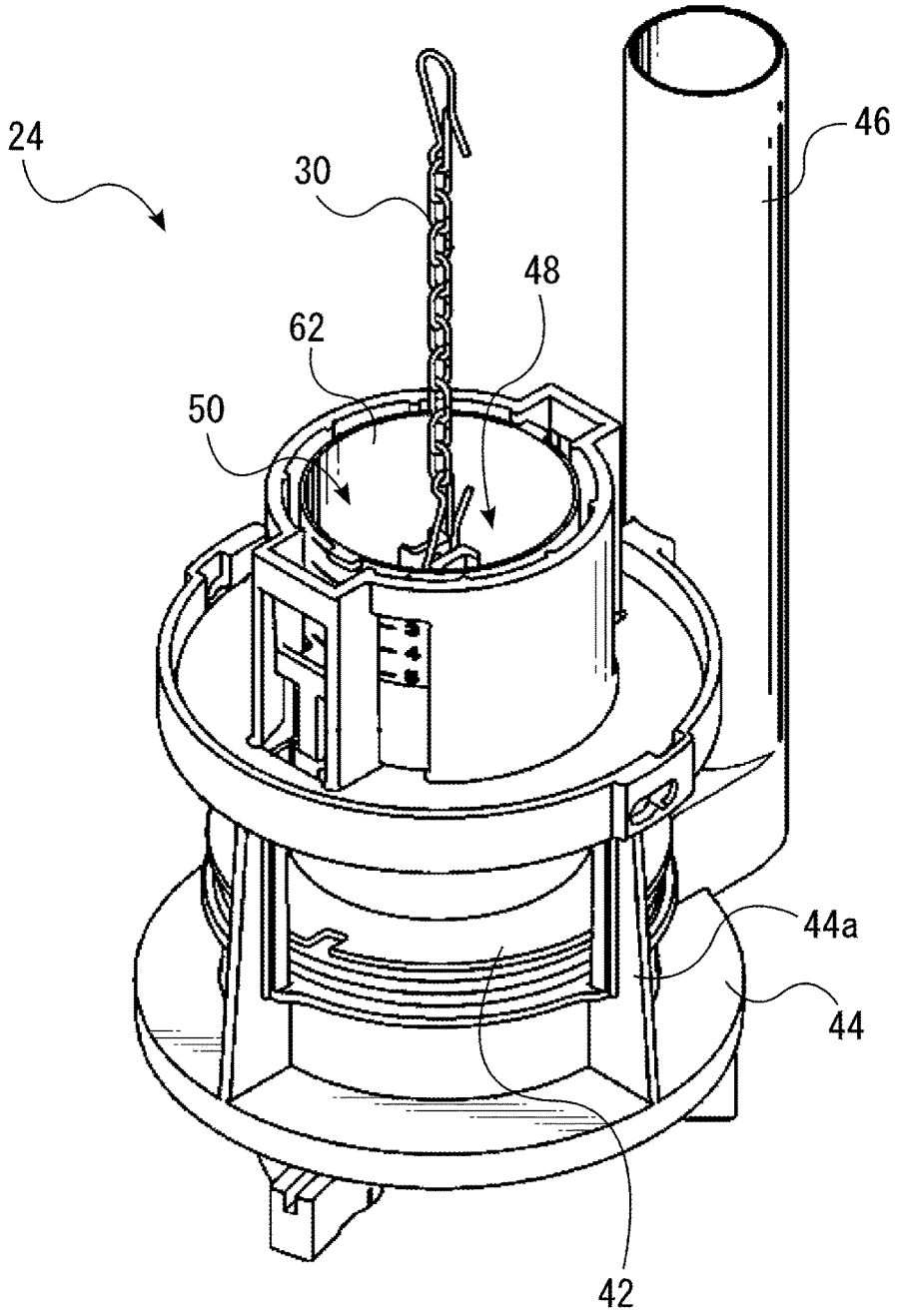
FIG. 5 is a perspective view of a discharge valve device in the embodiment of the invention.
Figure 6:
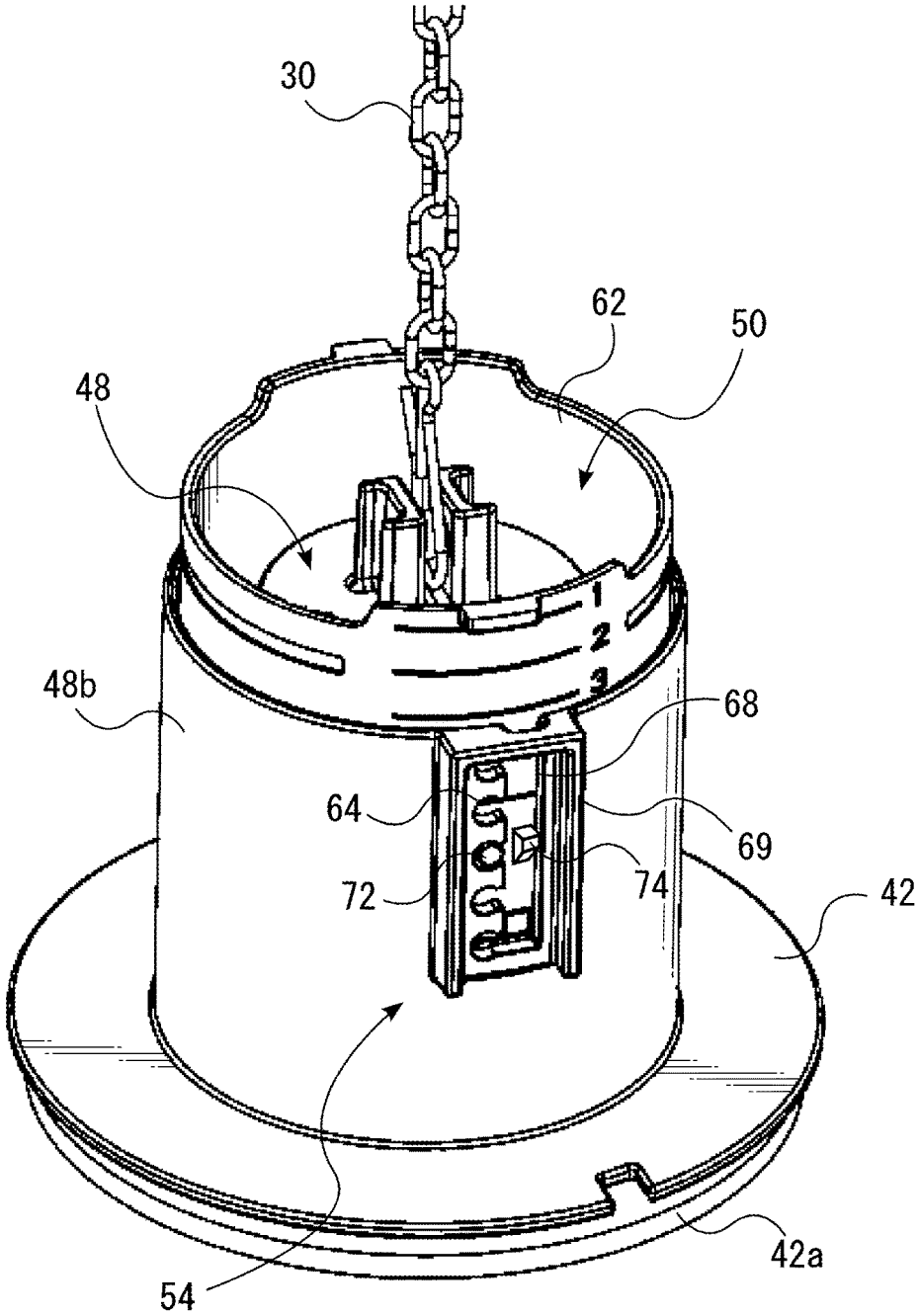
FIG. 6 is a perspective view showing the drop start variable timing mechanism in the discharge valve device of the embodiment of the invention.
Figure 7:
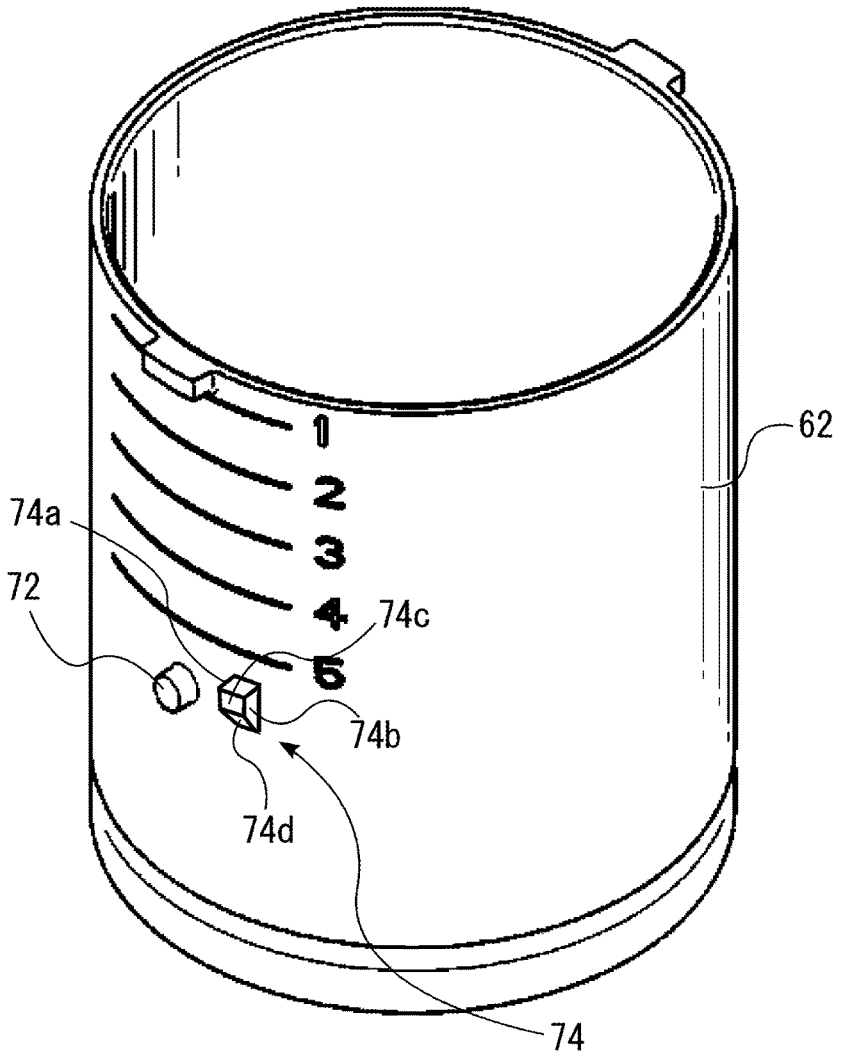
FIG. 7 is a perspective view showing the sidewall of the reservoir of the drop start variable timing mechanism in the discharge valve device of the embodiment of the invention.
Figure 8:
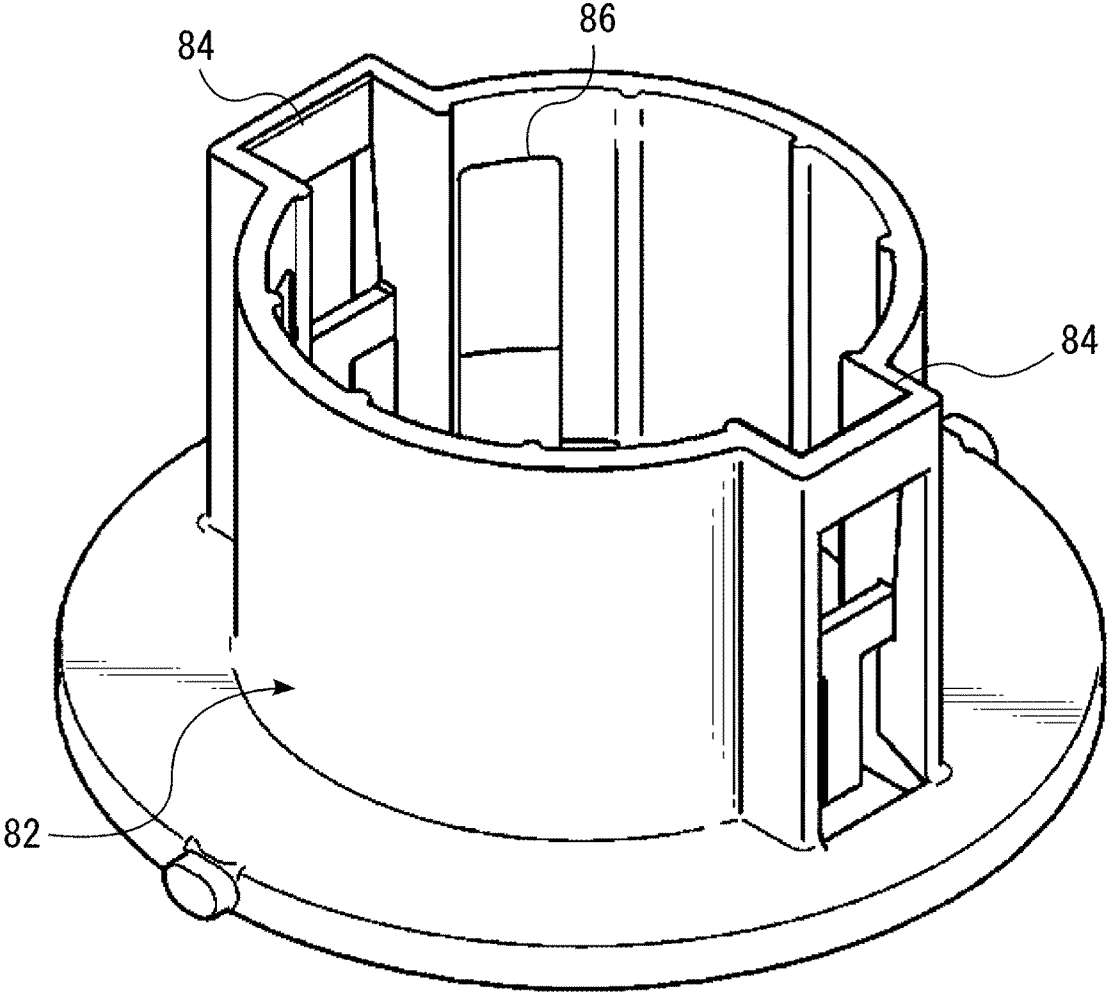
FIG. 8 is a perspective view showing a guide portion for guiding the valve body in the discharge valve device in the embodiment of the invention.

Next, referring to FIGS. 3-8, we explain a discharge valve device in the present embodiment. FIG. 3 is a cross section of a discharge valve device in the present embodiment wherein the dead water level DWL (the lowest water level) has been set to a high position (the high DWL setting). FIG. 4 is a cross section of a discharge valve device in the present embodiment wherein the dead water level DWL (the lowest water level) has been set to a low position (the low DWL setting). FIG. 5 is a perspective view of a discharge valve device in a first embodiment of the invention. FIG. 6 is a perspective view showing a drop start variable timing mechanism in the present embodiment. FIG. 7 is a perspective view showing the sidewall of the reservoir of the drop start variable timing mechanism in the present embodiment. FIG. 8 is a perspective view showing a guide portion for guiding the valve body in the discharge valve device in a first embodiment of the invention.

As shown in FIGS. 3-5, the discharge valve device 24 is disposed above the discharge port 32, and is what is known as a direct drive discharge valve device, in which a valve body 42 moves up and down to open and close the discharge port 32. The discharge valve device 24 comprises a pedestal 44 and an overflow pipe 46.

The pedestal 44 is disposed essentially directly above the discharge port 32. The pedestal 44 comprises multiple columns 44*a*, arrayed at a specified interval in a concentric circle around the center of the discharge port 32; the bottom-most portion thereof meshes with the discharge port 32. A discharge space 44*c* communicating with the discharge port 32 is formed at the bottom portion of the pedestal 44. Flush water is discharged from the discharge port 32 after passing through a discharge space 44*c* from an opening 44*d* between column 44*a* and column 44*a*.

The discharge valve device 24 comprises a valve body 42, a float 48, and a drop start variable timing mechanism 50. The valve body 42 has a rubber seal 42*a*, formed in a disk shape, at the bottom surface opposing the discharge port 32. This seal 42*a* is attached at the bottom of the valve body 42 by a seal support member 42*b*. This descending pipe rear wall 42*b* becomes the bottom surface of the valve body 42, and a through hole 42*c* for discharging flush water in the float 48 is formed at the center thereof.

The float 48 comprises a cylindrical inner cylinder 48*a*, closed at the top end, and an outer cylinder 48*b* on the outside of this inner cylinder 48*a*, left open at the top end; the bottom end of the inner cylinder 48*a* and the outer cylinder 48*b* is closed off by a bottom surface 48*c*; furthermore, the bottom end of the inner cylinder 48*a* and the outer cylinder 48*b* is connected to the valve body 42, and is integrally disposed as a single piece with the valve body 42. After the water level inside the reservoir tank 18 drops to a specified height, this float 48 drops in tandem with the water level.

The drop start variable timing mechanism 50 is a buoyancy adjustment mechanism for the float 48, and is installed around and on top of the float 48. The purpose of the drop start variable timing mechanism 50 is to move in tandem with the drop in water level inside the reservoir tank 18 so as to change (make variable) the water level inside the reservoir tank 18 when the valve body 42 and the float 48 start to drop.

The drop start variable timing mechanism 50 comprises a reservoir 52 and an adjustment portion 54. The reservoir 52 is formed in a region around and on top of the float 48. Specifically, the reservoir 52 comprises a donut-shaped vessel, open at the top, formed by the float 48 inner cylinder 48*a*, the outer cylinder 48*b*, and the bottom surface 48*c*. In addition, the reservoir 52 comprises a cylindrical cylindrical body 62, inserted into the outer cylinder 48*b* from above, fixed to the inside of the outer cylinder 48*b*, and open at the top and bottom ends. This cylindrical body 62 is formed over the entire circumference of the reservoir 52 as its sidewall, and is able to store flush water up to the top edge of the cylindrical body 62. Thus the reservoir 52 is formed by the inner cylinder 48*a* of the float 48, the outer cylinder 48*b*, the bottom surface 48*c*, and the cylindrical body 62, and forms a water storing area for storing flush water in the internal space formed by those elements (the area around and above the float 48).

As shown in FIGS. 6 and 7, the drop start variable timing mechanism 50 adjustment portion 54 comprises a support device having channels 64 disposed to penetrate the side surface of the outer cylinder 48*b*, and a raised portion 72 projecting from the cylindrical body 62 side surface toward the outer circumference. Multiple (specifically, five) channels 64 are disposed at predetermined intervals, at differing height positions along the axial direction of the outer cylinder 48*b*. I.e., the position of the projecting height of the cylindrical body 62, which projects higher than the outer cylinder 48*b*, is adjusted in response to the height position of the channels 64 on the outer cylinder 48*b* engaged by the cylindrical body 62 raised portion 72. Related to this, horizontally (side) extending lines 1 through 5 are described on the surface of the cylindrical body 62 corresponding to the positions of the five channels 64 on the outer cylinder 48*b* of the float 48; when the raised portion 72 is inserted into a specific channel 64, the line at a corresponding position is positioned immediately above the top edge of the outer cylinder 48*b,* and is visible from outside.

Also, the drop start variable timing mechanism 50 adjustment portion 54 comprises a lock device having: a vertical channel 68 which penetrates at the side surface of the outer cylinder 48*b* and extends vertically so as to communicate with a channel 64; and a protuberance 74 protruding from the side surface of the cylindrical body 62 toward the outer circumference. The protuberance 74 is approximately rectangular, and has a left side surface 74*a,* a right side surface 74*b,* a front surface 74*c,* and a bottom surface 74*d.* The bottom surface 74*d* is sloped upward from the side surface of the cylindrical body 62 toward the outer circumference side.

As shown in FIG. 6, the protuberance 74 is inserted into the vertical channel 68 with the raised portion 72 engaging the channel 64. Thus if an attempt is made to rotate the cylindrical body 62 in the circumferential direction with the raised portion 72 engaging the channel 64, contact between the protuberance 74 right side surface 74*b* and the vertical channel 68 restricts that rotational movement of the cylindrical body 62 in the circumferential direction.

In the area formed by the float 48 outer cylinder 48*b* vertical channel 68 and channels 64, a wall 69 is disposed so as to surround this vertical channel 68 and channels 64 and to project horizontally outward. Both sides 69*a* of this wall 69 extend along the axial direction (up-down direction) of the float 48. The end in the outward direction of this wall 69 is formed at a position further out than the vertical channel 68, channels 64, and raised portion 72 serving as the adjusting portion.

As shown in FIGS. 5 and 8, a guide portion 82 is disposed on the pedestal 44, and the float 48 outer cylinder 48*b* is formed in an insertable cylindrical shape. Guide channels 84, projecting outward and extending up and down, are formed at two opposing locations on the outer perimeter surface of the guide portion 82. The wall 69 formed on the outside of the outer cylinder 48*b* on above-described float 48 is inserted through a minute gap into the guide channels 84 on this guide portion 82, guiding the up and down movement of the reservoir 52. Up and down movement of the valve body 42 is stabilized by this guide portion 82.

Two openings 86 extending in the vertical direction along the guide channels 84 are formed on both sides of one of the guide channels 84 on the guide portion 82. The openings 86 are formed in an essentially rectangular shape. The openings 86 are formed in the guide portion 82, therefore when there is excess flush water over the set stored amount set in the interior of the guide portion 82, that excess flush water can be released from the openings 86. The amount of stored water in the reservoir 52 is thus stable. Also, the wall 69 formed on the outside of the reservoir 52 outer cylinder 48*b* is inserted into a guide channel 84 extending in the up-down direction on the guide portion 82, so that movement of the valve body 42 and the float 48 in the circumferential direction is restricted.

Here the surface area of the openings 86 is formed so that the flush water level inside the guide portion 82 drops at approximately the same speed as the flush water level inside the reservoir tank 18.

Figure 9:
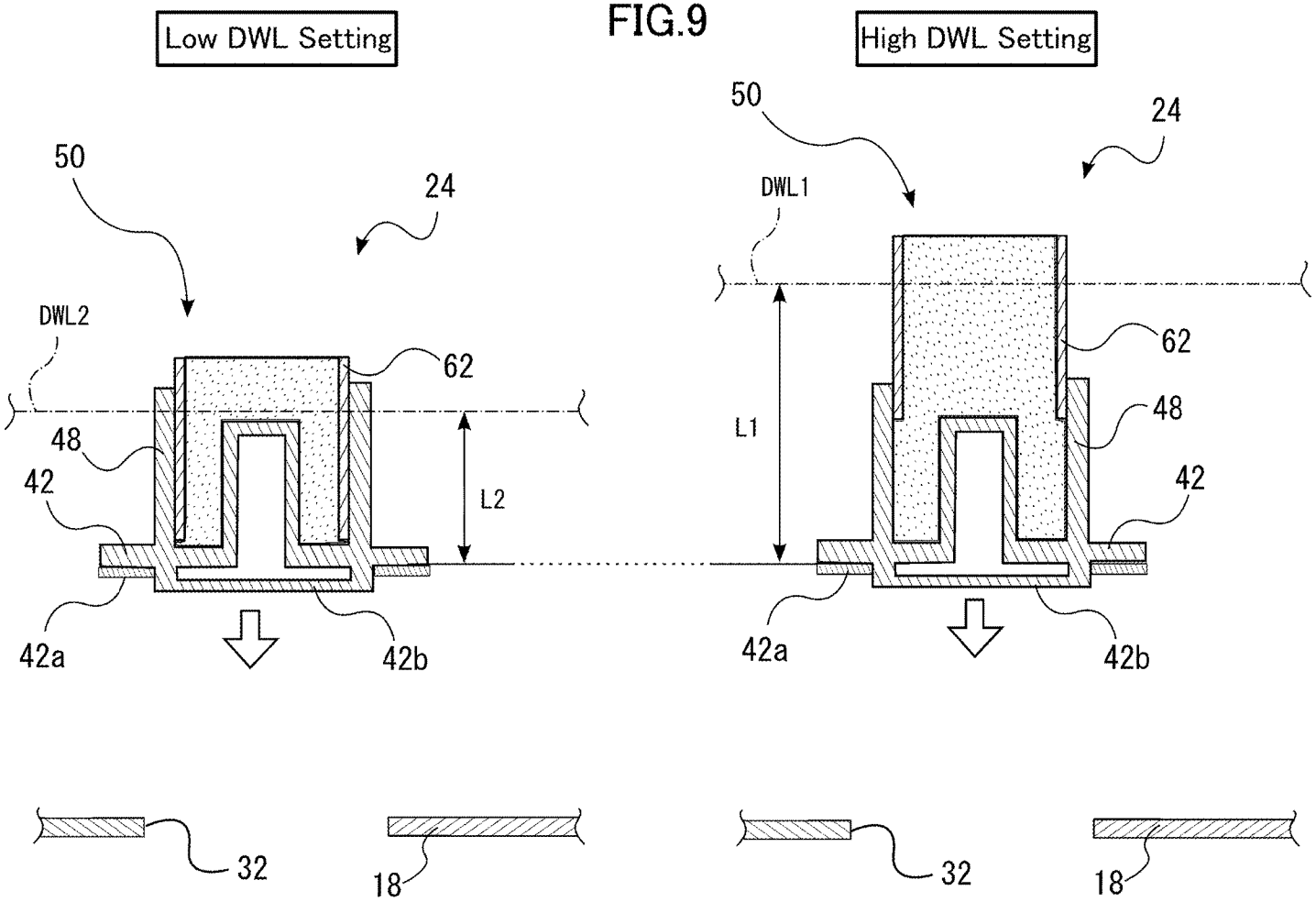
FIG. 9 is a diagram explaining the basic operation of a discharge valve device in the embodiment of the invention.

Next, referring to FIG. 9, we explain the basic operation of a discharge valve device in the present embodiment. FIG. 9 is a diagram explaining the basic operation of a discharge valve device in an embodiment of the invention.

When the amount of flush water supplied from the reservoir tank 18 is set at a large amount, the difference in the discharge valve device 24 increases between the flush water level (stopped water level) when supply to the reservoir tank 18 is completed, and the above-described dead water level. I.e., a setting is made to the low DWL shown on the left of FIG. 9 (referred to as the "low DWL setting"). Conversely, when the amount of flush water supplied from the reservoir tank 18 is set to be low, the difference between the stopped water level and the dead water level decreases. I.e., a setting is made to the high DWL shown on the right of FIG. 9 (referred to as the "high DWL setting").

Once the water level in the reservoir tank 18 drops to predetermined water level heights WL1, WL2, it then drops in tandem with the subsequent drop in water level, as shown by the hollow arrow in the figure.

The drop start variable timing mechanism 50 enables varying of the timing at which the valve body 42 and float 48 start to drop in tandem with the drop in water level inside the reservoir tank 18. Specifically, the height position of the valve body 42 relative to the water levels WL1, WL2 varies when the valve body 42 and float 48 start to drop. Note that the height position of the valve body 42 relative to the water levels WL1, WL2 is the relative height between the water levels WL1, WL2 and the valve body 42; more specifically, this refers to the distances L1, L2 from the flush water surface to the valve body 42.

Here, as shown in FIG. 9, both the low DWL setting and the high DLW setting cases take essentially the same time from the start of valve body 42 dropping until the discharge port 32 is closed. At the same time, the low DWL setting and the high DWL setting have differing drop start timings.

Therefore by using a discharge valve device 24 according to the present embodiment, the valve body 42 drop start timing can be made variable, so that the discharge port 32 release time can also be varied. Thus the amount of flush water to the toilet can be made variable, and the amount of flush water can be adjusted according to toilet type.

Figure 10A:
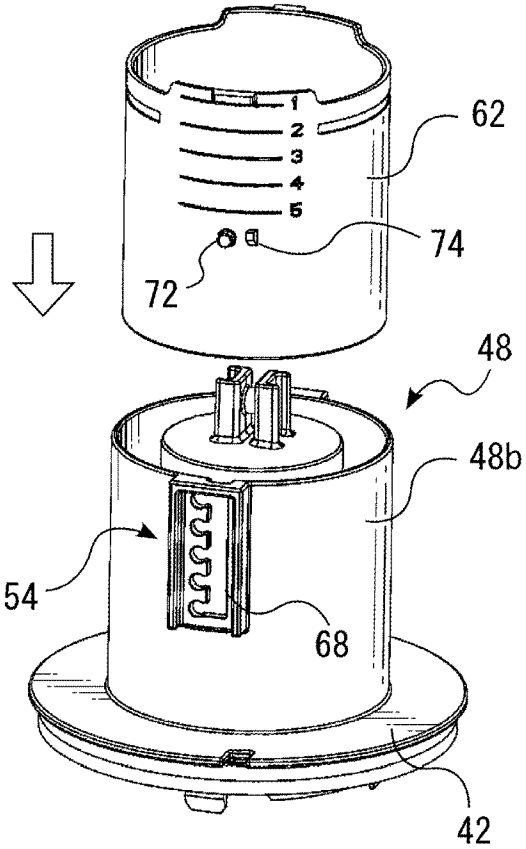
FIGS. 10A-10C are diagrams explaining a method for setting a sidewall projection height position when setting the discharge valve device of the present embodiment to a high DWL.
Figure 10B:
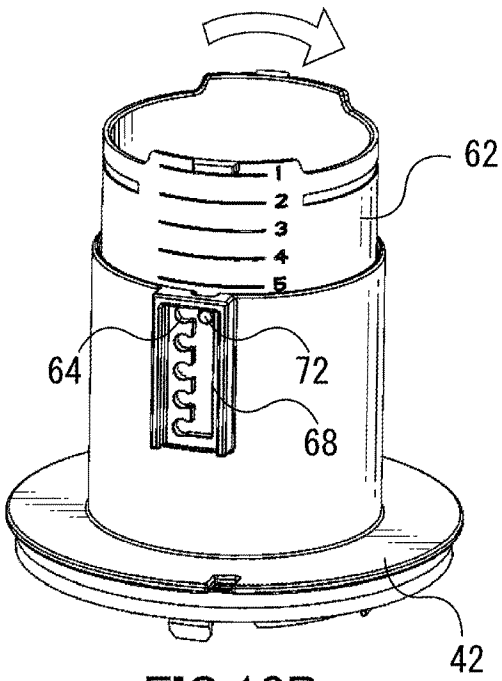
Figure 10C:
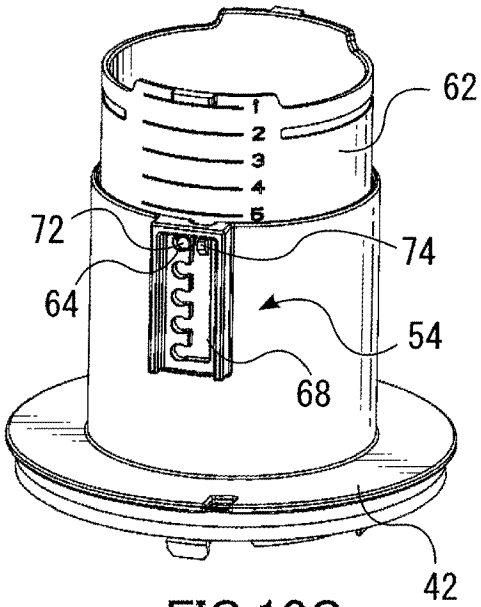
Figures 11A, 11B, 11C:
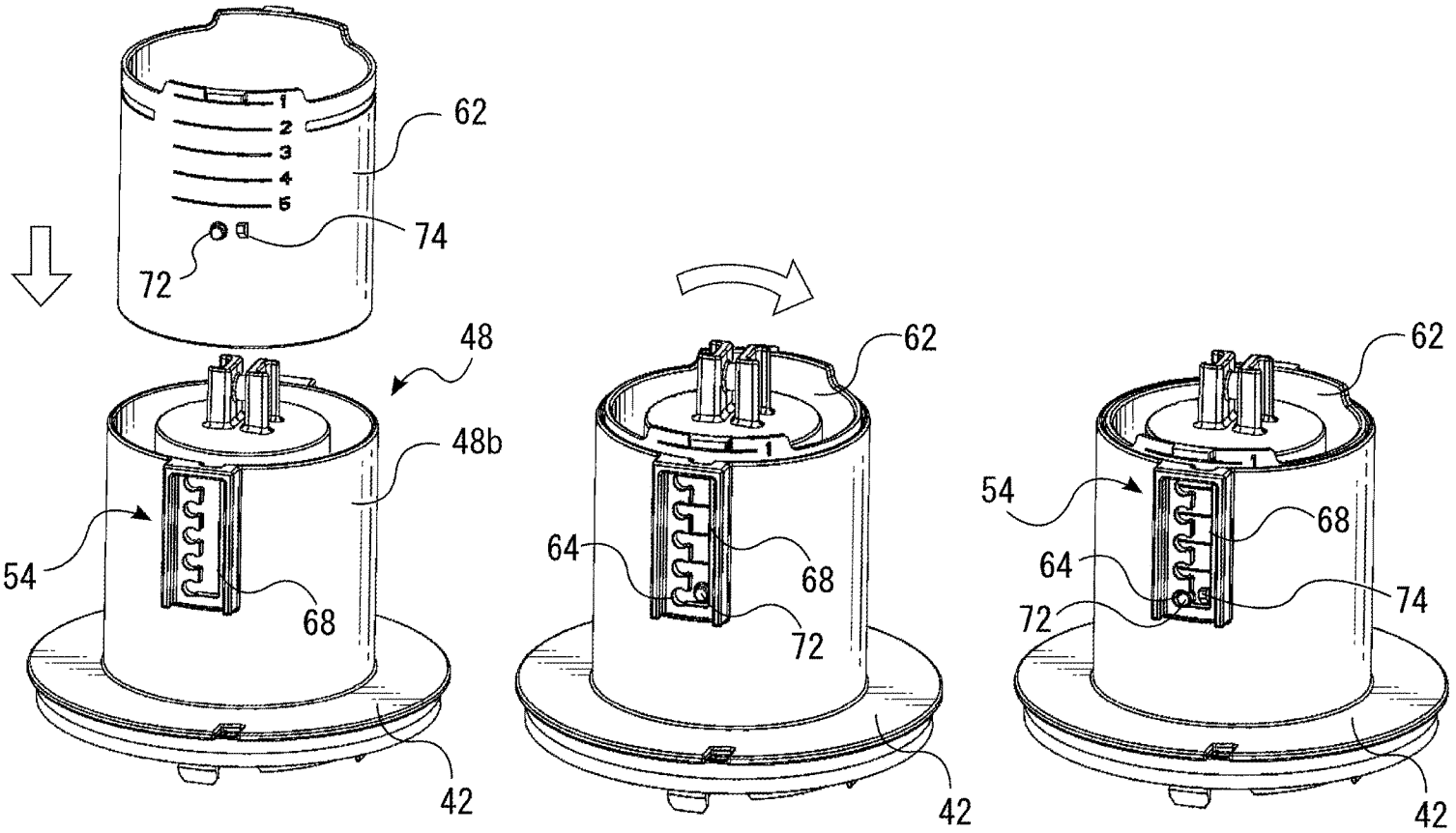
FIGS. 11A-11C are diagrams explaining a method for setting a projection height position on the sidewall when setting the discharge valve device of the present embodiment to a low DWL.

Next, referring to FIGS. 10A-10C and 11A-11C, we will explain a method for setting the drop start variable timing mechanism sidewall projection height position in the present embodiment. FIGS. 10A-10C are diagrams explaining a method for setting a sidewall projection height position when setting the discharge valve device to high DWL in the present embodiment. FIGS. 11A-11C are diagrams explaining a method for setting a sidewall projection height position when setting the discharge valve device to low DWL in the present embodiment.

As shown in FIG. 10A, when the cylindrical body 62 is inserted upward into the outer cylinder 48*b* with the cylindrical body 62 raised portion 72 aligned to the outer cylinder 48*b* vertical channel 68, the raised portion 72 passes into the vertical channel 68 and the surface 74*d* of the protuberance 74 disposed on the outer perimeter surface of the cylindrical body 62 contacts the top end of the outer cylinder 48*b*. As shown in FIG. 10B, when the cylindrical body 62 is further pushed into the outer cylinder 48*b,* the cylindrical body 62 is inserted into the outer cylinder 48*b* as the protuberance 74 bottom surface 74*d* slides on the top end of the outer cylinder 48*b*. At this point the protuberance 74 is inserted into the outer cylinder 48*b* as the outer cylinder 48*b* and the cylindrical body 62 slightly elastically deform.

As shown in FIG. 9(*c*), when setting to high DWL, after the cylindrical body 62 is pressed into the outer cylinder 48*b* until the raised portion 72 is at a position parallel to the uppermost channels 64, the cylindrical body 62 is rotated in the clockwise direction as seen in top plan view, so that the raised portion 72 fits into the channels 64. At this point, the protuberance 74 is inserted into the vertical channel 68, and elastic deformations of the outer cylinder 48*b* and the cylindrical body 62 is released, restoring the original shapes. Therefore motion of the cylindrical body 62 in the axial and circumferential directions is restricted by the engaging of the raised portion 72 and a channel 64 and the insertion of the protuberance 74 into the vertical channel 68, and the cylindrical body 62 is affixed inside the outer cylinder 48*b*.

In a discharge valve device 24 set to high DWL, the raised portion 72 of the cylindrical body 62 of the reservoir 52 engages with the highest level horizontal channel 106 on the outer cylinder 48*b* of the float 48, and the projection height of the cylindrical body 62 relative to the outer cylinder 48*b* is at the very highest position. The amount of flush water discharged from the discharge port 32 is minimized at this time.

As shown in FIGS. 11A-11C, when setting to low DWL, after the cylindrical body 62 is pressed into the outer cylinder 48*b* until the raised portion 72 is at a position parallel to the lowermost channels 64, the cylindrical body 62 is rotated in the clockwise direction, as seen in top plan view, so that the raised portion 72 engages a channel 64. At this point, the protuberance 74 is inserted into the vertical channel 68, and elastic deformation of the outer cylinder 48*b* and cylindrical body 62 is released, restoring the original shapes. As in the high DWL case, therefore, motion of the cylindrical body 62 in the axial and circumferential directions is restricted by the engaging of the raised portion 72 and the channels 64 and the insertion of the protuberance 74 into the vertical channel 68, and the cylindrical body 62 is affixed inside the outer cylinder 48*b*.

In a discharge valve device 24 set to low DWL, the raised portion 72 of the cylindrical body 62 of the reservoir 52 engages the lowest level horizontal channel 106 on the outer cylinder 48*b* of the float 48, and the projection height of the cylindrical body 62 relative to the outer cylinder 48*b* is at the very lowest position. The amount of flush water discharged from the discharge port 32 is maximized at this time.

Next, referring to FIGS. 12-16, we explain the series of operations by the discharge valve device in the present embodiment, from start to completion of supply of flush water to the toilet main body from the reservoir tank device. FIGS. 12-15 are diagrams explaining a series of operations in a discharge valve device in an embodiment of the invention. Note that in FIGS. 12-15, the discharge valve device at a low DWL setting is shown on the left side of the figure, and the discharge valve device at a high DWL setting is shown on the right side of the figure.

In the discharge valve device 24, a greater amount of flush water is discharged from the discharge port 32 in the low DWL setting than in the high DWL setting. Conversely, a smaller amount of flush water is discharged from the discharge port 32 in the high DWL setting than in the low DWL setting.

Figure 12:
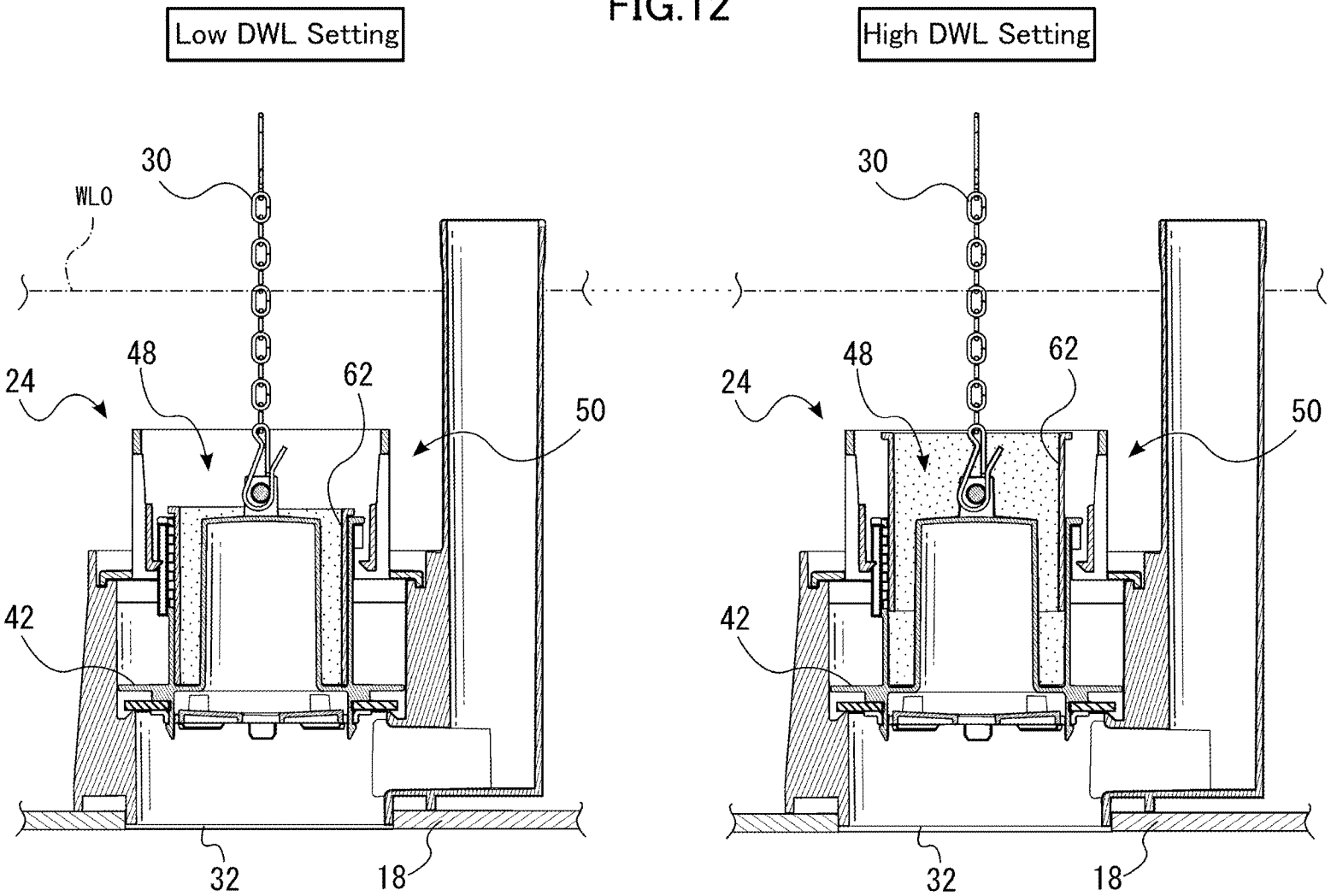
FIG. 12 is a diagram explaining a series of operations in a discharge valve device in the embodiment of the invention.

FIG. 12 shows the state prior to start of flush water discharge. In the discharge valve device 24 in both the low DWL setting and the high DWL setting, the discharge port 32 is closed by the valve body 42. At this point, the water level inside the reservoir tank 18 is at stopped water level WL0.

Following this, the spindle 28 turns when the lever handle 26 is operated (see FIG. 2). When the spindle 28 turns, the valve body 42 is pulled up by the bead chain 30 and moves to the highest position in the movable range. Flush water is in this way discharged from the discharge port 32.

Figure 13:
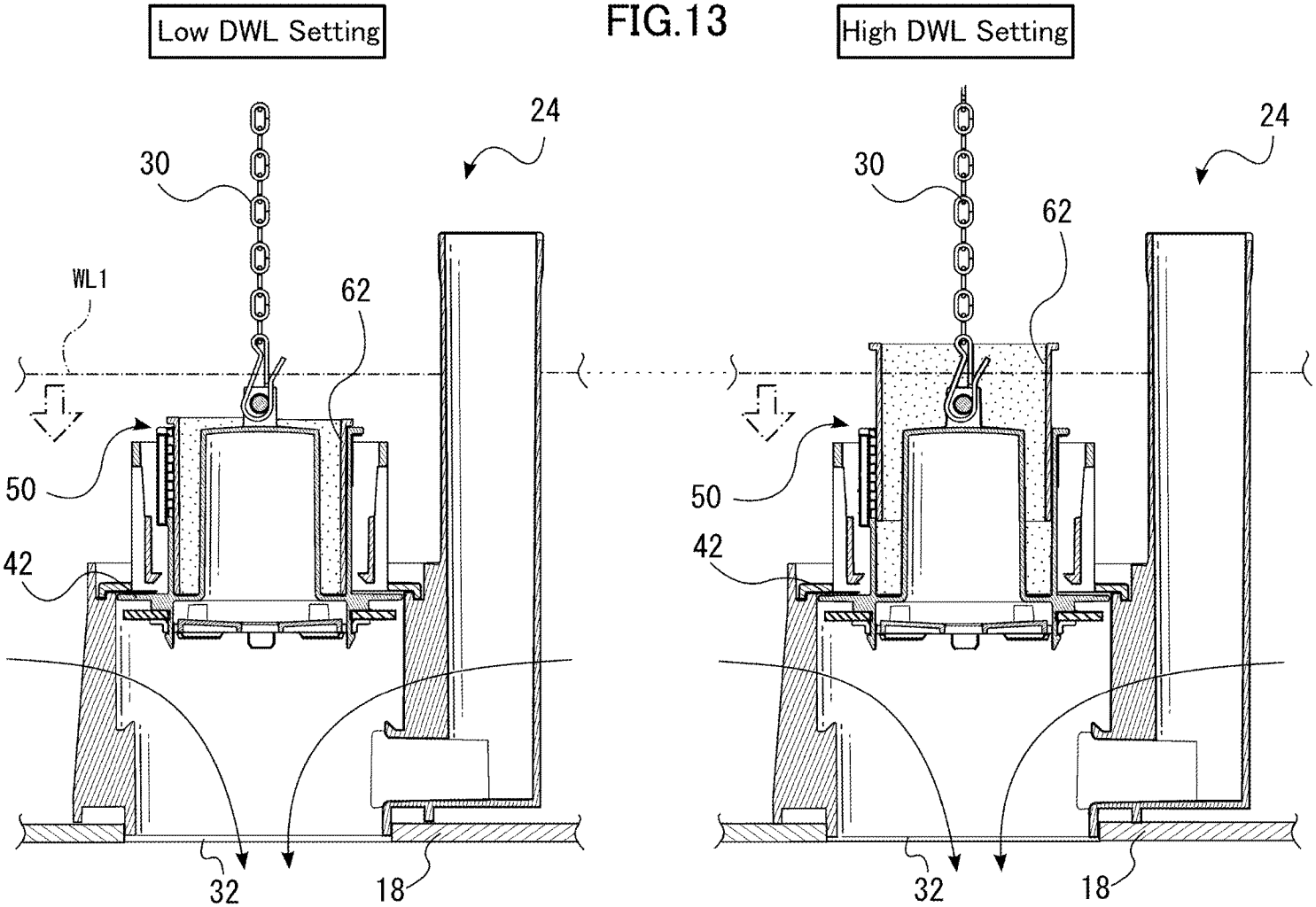
FIG. 13 is a diagram explaining a series of operations in a discharge valve device in the embodiment of the invention.

As shown in FIG. 13, in a discharge valve device 24 at a high DWL setting, when the flush water is discharged and the water level inside the reservoir tank 18 reaches a water level WL1 of a predetermined height, balance is lost between the float 48 buoyancy and its own weight, and the valve body 42 and supply float 38 start to drop in tandem with subsequent lowering of the water level. At the same time, in a discharge valve device 24 at a low setting, float 48 buoyancy acts sufficiently against its own weight that the valve body 42 remains stationary at the highest position. Note that a dropping water level is shown by a diagonally shaded arrow, and discharged flush water is shown by lines with arrows.

Figure 14:
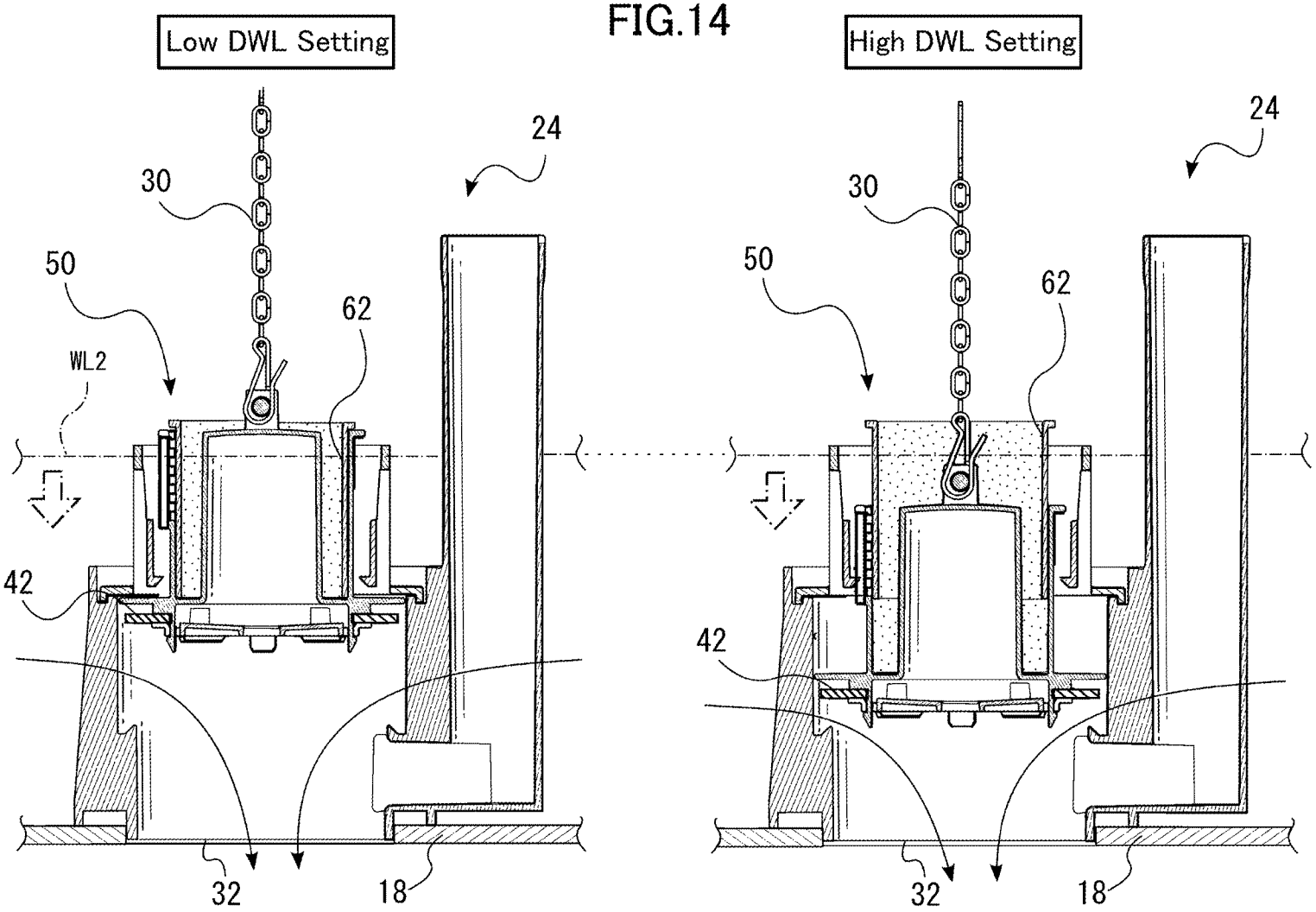
FIG. 14 is a diagram explaining a series of operations in a discharge valve device in the embodiment of the invention.

Next, as shown in FIG. 14, in a discharge valve device 24 at a high DWL setting, the valve body 42 continues to drop in tandem with the dropping water level. On the other hand, in a discharge valve device 24 at a low DWL setting, when the water level inside the reservoir tank 18 reaches a water level WL2 of a predetermined height, the balance between the float 48 buoyancy and its own weight is lost, and the valve body 42 and supply float 38 start to drop in tandem with subsequent lowering of the water level. I.e., in the low DWL setting discharge valve device 24, the valve body 42 starts to drop later than the high DWL setting discharge valve device 24.

Also, as shown in FIG. 14, flush water flows out from the guide portion 82 openings 86 even when the valve body 42 continues to drop, so that flush water inside the guide portion 82 does not accumulate in the guide portion 82, and a weight exceeding the flush water stored in the reservoir 52 is not applied to the float 48.

Figure 15:
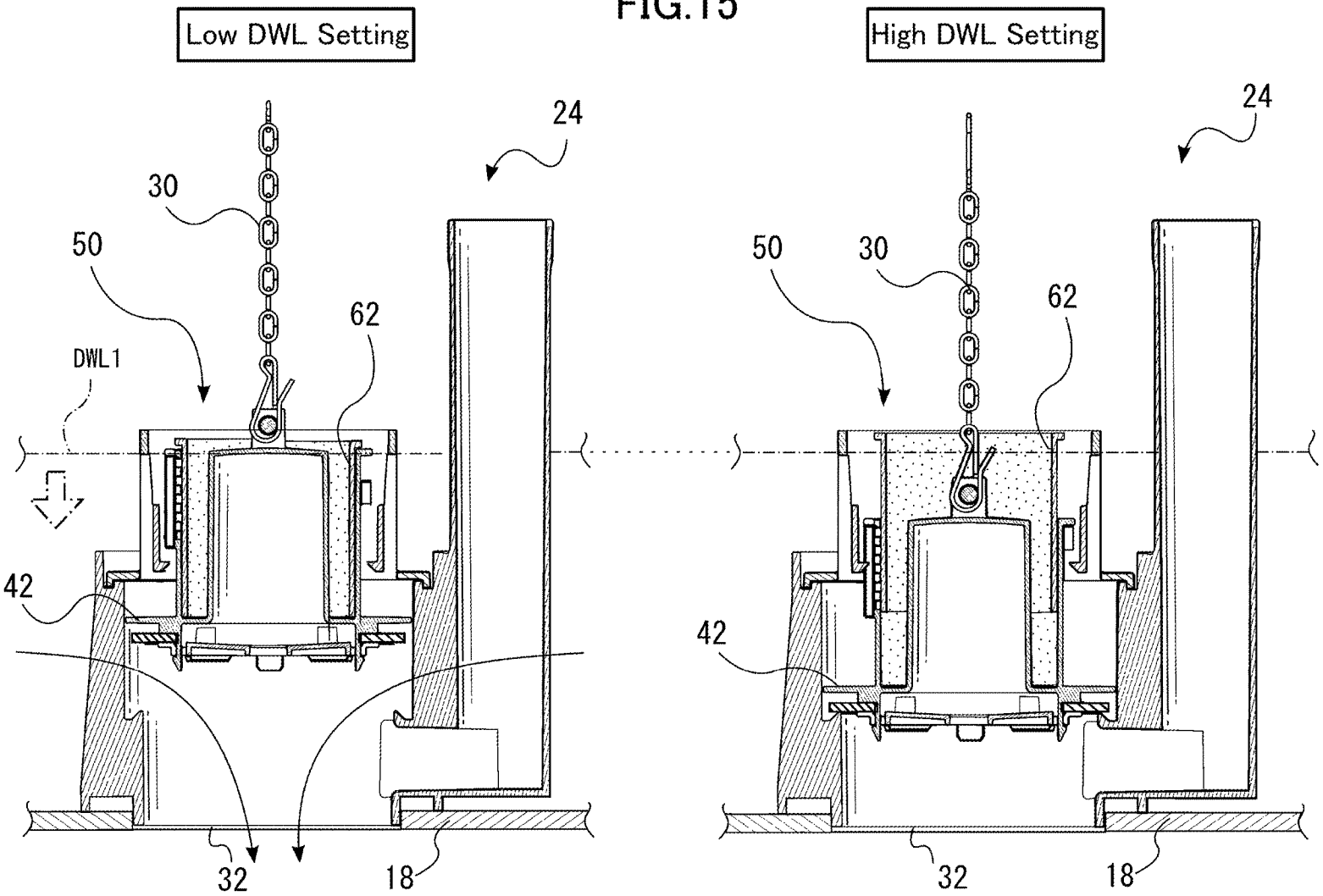
FIG. 15 is a diagram explaining a series of operations in a discharge valve device in the embodiment of the invention.

Next, as shown in FIG. 15, in a discharge valve device 24 at a high DWL setting, the valve body 42 reaches the lowest position in the movable range, closing the discharge port 32. Note that when the valve body 42 moves in tandem with the dropping water level and approaches the lowest position, it is drawn into the flow of flush water discharged from the discharge port 32 and drops rapidly to reach the lowest position. Here, in a discharge valve device 24 at a high DWL setting, the water level when the discharge port 32 is closed by the valve body 42 is the dead water level DWL1. In a discharge valve device 24 at a low DWL setting, on the other hand, the valve body 42 continues to drop in tandem with the dropping water level.

Figure 16:
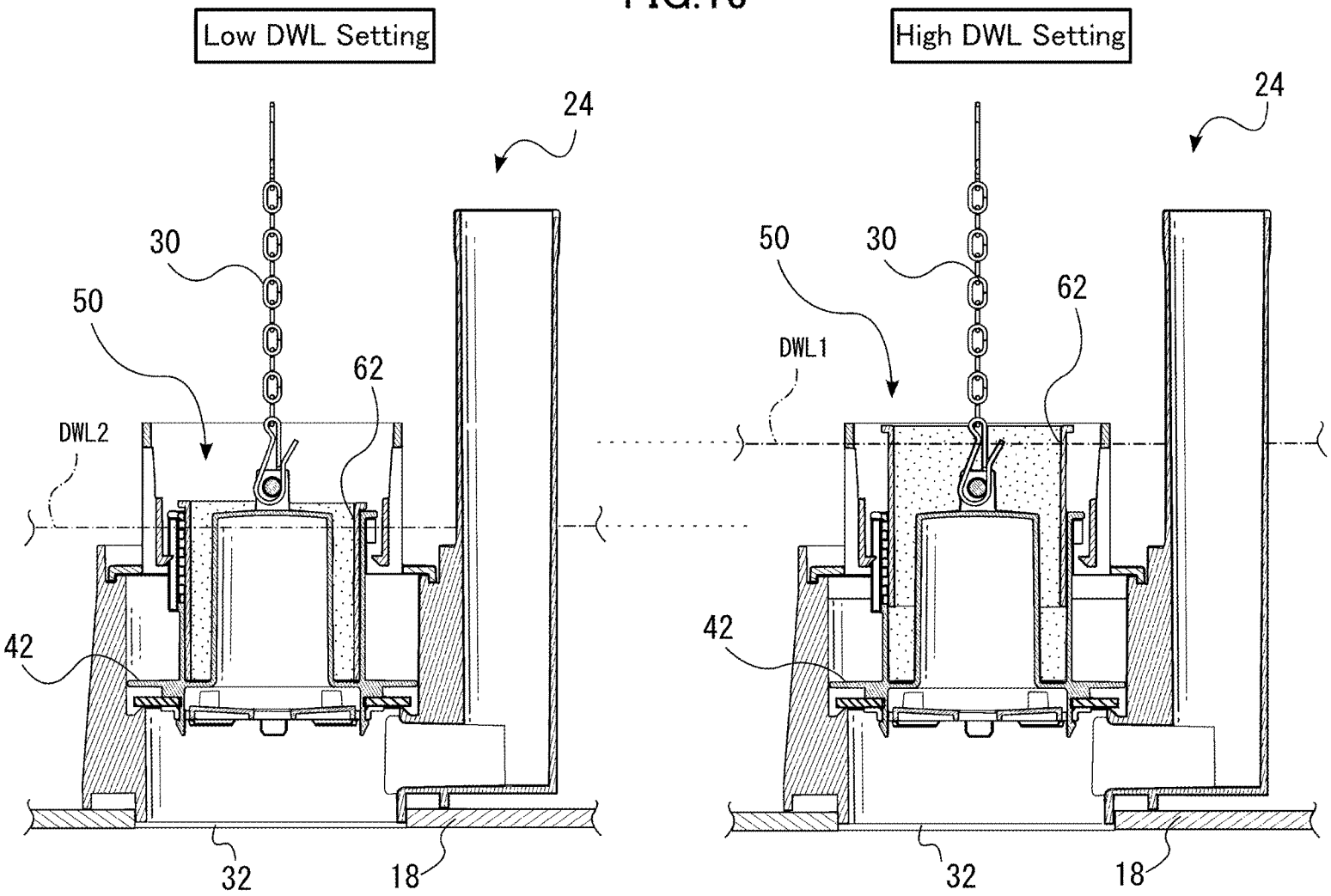
FIG. 16 is a diagram explaining a series of operations in a discharge valve device in the embodiment of the invention.

Next, as shown in FIG. 16, in a discharge valve device 24 at a low DWL setting, as well, the valve body 42 reaches the lowest position in the movable range later than a discharge valve device 24 at a high DWL setting, thereby closing the discharge port 32. Note that the point at which the valve body 42 suddenly drops to the lowest position when approaching the lowest position is the same as for a discharge valve device 24 at a high DWL setting. Here, in the discharge valve device 24 at a low DWL setting, the water level when the discharge port 32 is closed by the valve body 42 is dead water level DWL2, which is lower than dead water level DWL1 for the discharge valve device 24 at a low DWL setting. On the other hand, in both settings of the discharge valve device 24 the stopped water level WL0 (see FIG. 12) is the same, so a greater amount of flush water is released from the discharge port 32 with the discharge valve device 24 in the low DWL setting than with the discharge valve device 24 in the high DWL setting.

As described above, using the discharge valve device 24 of the present embodiment, the height position of the valve body 42 relative to the water level when the valve body 42 starts to drop can be changed, thus enabling the timing at which the valve body 42 starts to drop to be varied. By making the timing at which the valve body 42 starts to drop variable, the discharge port 32 release time can be changed, and the amount of water drained from the discharge port 32, i.e., the amount of flush water to the toilet, can be changed. The amount of flush water can thus be adjusted according to toilet type.

Also, the reservoir tank device 4 of the present embodiment comprises a discharge valve device 24, therefore the flush water amount can be adjusted according to toilet type. In addition, the flush toilet device 1 of the present embodiment comprises a reservoir tank device 4, therefore the flush water amount can be adjusted according to toilet type.

Next we explain the operation and effect of a flush toilet in the present embodiment.

In the present embodiment, the protuberance 74 is inserted into the vertical channel 68 with the raised portion 72 engaging channel 64. Thus when an attempt is made to rotate the cylindrical body 62 in the circumferential direction with the raised portion 72 engaging a channel 64, the contact between the protuberance 74 right side surface 74*b* and the vertical channel 68 restricts that rotational movement of the cylindrical body 62 in the circumferential direction. Thus the drop start variable timing mechanism 50, by causing the raised portion 72 to engage a channel 64, prevents the projection height of the cylindrical body 62 from being easily changed by a user or by external interference once the projection height of the cylindrical body 62 has been set.

Also, the protuberance 74 bottom surface 74*d* is sloped upward from the side surface of the cylindrical body 62 toward the outer circumference side. Thus when the cylindrical body 62 is inserted into the outer cylinder 48*b*, the bottom surface 74*d* of the protuberance 74 disposed on the side surface of the cylindrical body 62 is inserted as the top end of the outer cylinder 48*b* slides, thereby facilitating insertion of the cylindrical body 62 into the outer cylinder 48*b*.

We have explained above an embodiment of the art disclosed in the present application, but the art disclosed by the application is not limited to the above.

For example, in the above-described present embodiment, a raised portion 72 is formed on the cylindrical body 62 of the reservoir 52, and channels 64 and vertical channel 68 are formed on the float 48 outer cylinder 48*b*, but channels and a vertical channel could conversely also be formed on the cylindrical body 62 of the reservoir 52, and a raised portion formed on the outer cylinder 48*b* of the float 48.

Each element comprised by the above-described embodiments may be combined to the extent technically feasible, and such combinations are also included in the scope of the present invention so long as they include the features of the present invention.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A discharge valve device attached to a reservoir tank for storing flush water, the discharge valve device being configured to open and close a discharge port disposed on a bottom surface of the reservoir tank, the discharge valve device comprising:

a valve body configured to move up and down so as to open and close the discharge port;

a float including an outer cylinder mounted to the valve body, the float and the outer cylinder being configured to drop in tandem with a lowering of a water level inside the reservoir tank; and a drop start variable timing mechanism attached to the float, the drop start variable timing mechanism being configured to vary a timing at which the valve body starts to drop;

wherein the drop start variable timing mechanism includes:

a reservoir configured in the outer cylinder of the float so as to open upward, the reservoir having a sidewall over an entire circumference on an outer circumference side of the reservoir so that flush water can be stored up to a top end of the sidewall, the sidewall of the reservoir being slidably attached to the outer cylinder of the float;

an adjustment portion configured to adjust a height position of the top end of the sidewall relative to a bottom surface of the reservoir so as to adjust a flush water amount stored in the reservoir of the float and vary the timing at which the valve body starts to drop according to the flush water amount stored in the reservoir; and wherein the adjustment portion includes:

a support device configured to position the height position of the top end of the sidewall relative to the bottom surface of the reservoir; and a lock device configured to prevent the support device from being released to position the height position of the top end of the sidewall relative to the bottom surface of the reservoir.

2. The discharge valve device according to claim 1, wherein the drop start variable timing mechanism includes:

a cylindrical body configured to be inserted from above into an inside of the outer cylinder of the float, the cylindrical body being affixed to the inside of the outer cylinder;

wherein the support device includes:

multiple channels at differing height positions, the multiple channels being disposed on a side surface of the outer cylinder; and a raised portion configured to project from a side surface of the cylindrical body outwardly, the raised portion being configured to engage one channel of the multiple channels when the cylindrical body is rotated in a circumferential direction of the cylindrical body; and wherein the lock device prevents the cylindrical body from rotating in the circumferential direction when the raised portion engages in the channel.

3. The discharge valve device according to claim 2, wherein the lock device includes:

a vertical channel disposed on the side surface of the outer cylinder; and a protuberance protruding from the side surface of the cylindrical body, the protuberance being configured to be inserted into the vertical channel when the raised portion engaged in the channel; and wherein a bottom surface of the protuberance is configured to be sloped upward toward an outside of the protuberance.

4. A reservoir tank device comprising the discharge valve device according to claim 1.

5. A flush toilet comprising the reservoir tank device according to claim 4.

* * * * *